US009054478B2

(12) United States Patent
Golko et al.

(10) Patent No.: US 9,054,478 B2
(45) Date of Patent: Jun. 9, 2015

(54) ELECTRICAL CONNECTOR HAVING A DESIGNED BREAKING STRENGTH

(71) Applicant: Apple Inc., Cupertino, CA (US)

(72) Inventors: Albert J. Golko, Saratoga, CA (US); Ibuki Kamei, San Jose, CA (US); Warren Z. Jones, San Jose, CA (US); Paul J. Thompson, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 201 days.

(21) Appl. No.: 13/779,433

(22) Filed: Feb. 27, 2013

(65) Prior Publication Data

US 2014/0242848 A1 Aug. 28, 2014

(51) Int. Cl.

| | |
|---|---|
| ***H01R 13/58*** | (2006.01) |
| ***H01R 43/20*** | (2006.01) |
| ***H01R 13/504*** | (2006.01) |
| *H01R 24/62* | (2011.01) |
| *H01R 107/00* | (2006.01) |

(52) U.S. Cl.

CPC ..... *H01R 43/20* (2013.01); *Y10T 29/49204* (2015.01); *H01R 13/504* (2013.01); *H01R 24/62* (2013.01); *H01R 2107/00* (2013.01); *H01R 2201/06* (2013.01)

(58) Field of Classification Search

CPC ..... H01R 13/53
USPC ..... 439/475, 923
See application file for complete search history.

(56) References Cited

U.S. PATENT DOCUMENTS

| | | | | | |
|---|---|---|---|---|---|
| 2,986,719 | A | * | 5/1961 | Adams | 439/152 |
| 3,155,882 | A | * | 11/1964 | Casey | 361/636 |
| 3,611,274 | A | * | 10/1971 | Low et al. | 439/163 |
| 3,622,946 | A | * | 11/1971 | Rogers | 439/475 |
| 4,077,690 | A | * | 3/1978 | Koether | 439/320 |
| 4,109,989 | A | * | 8/1978 | Snyder et al. | 439/140 |
| 4,490,002 | A | * | 12/1984 | Fowler | 439/145 |
| 4,550,967 | A | * | 11/1985 | Riches et al. | 439/332 |
| 4,583,084 | A | * | 4/1986 | Henderson et al. | 340/573.4 |
| 4,698,717 | A | * | 10/1987 | Scheid | 361/1 |
| 4,707,046 | A | * | 11/1987 | Strand | 439/314 |
| 4,793,820 | A | * | 12/1988 | Czech et al. | 439/177 |
| 4,857,013 | A | * | 8/1989 | Peters | 439/484 |
| 4,863,397 | A | * | 9/1989 | Hatch, Jr. | 439/475 |
| 4,944,686 | A | * | 7/1990 | Gertz | 439/175 |
| 5,090,916 | A | * | 2/1992 | Magnier | 439/352 |
| 5,346,406 | A | * | 9/1994 | Hoffman et al. | 439/474 |
| 5,478,119 | A | * | 12/1995 | Dye | 285/26 |

(Continued)

FOREIGN PATENT DOCUMENTS

| | | |
|---|---|---|
| EP | 0202728 B1 | 5/1990 |
| EP | 0803939 B1 | 7/2001 |
| EP | 2476167 A2 | 7/2012 |

*Primary Examiner* — Neil Abrams

(74) *Attorney, Agent, or Firm* — Kilpatrick Townsend & Stockton LLP

(57) ABSTRACT

An improved method is employed to produce a plug connector having a defined breaking strength. The plug connector is receivable in a receptacle connector disposed in an electronic device. The plug connector has an inner enclosure bonded to a tab of the connector. The bonds are designed to break at a torque that is less than the breaking strength of the tab of the connector and/or the receptacle connector. The designed breaking strength protects the receptacle connector and/or the electronic device from damage when a force is applied to the plug connector.

18 Claims, 9 Drawing Sheets

(56) References Cited

U.S. PATENT DOCUMENTS

| | | | | |
|---|---|---|---|---|
| 5,478,252 | A * | 12/1995 | Lecomte et al. | 439/180 |
| 5,562,463 | A * | 10/1996 | Tan | 439/76.1 |
| 5,971,777 | A * | 10/1999 | Garside | 439/131 |
| 6,146,188 | A * | 11/2000 | Snyder | 439/475 |
| 6,162,082 | A * | 12/2000 | Karsten et al. | 439/318 |
| 6,186,803 | B1 * | 2/2001 | Garside | 439/131 |
| 6,364,675 | B1 * | 4/2002 | Brauer et al. | 439/159 |
| 6,461,192 | B1 * | 10/2002 | Kwoka | 439/505 |
| 6,485,322 | B1 * | 11/2002 | Branch et al. | 439/357 |
| 6,612,874 | B1 * | 9/2003 | Kunz et al. | 439/640 |
| 6,623,885 | B1 * | 9/2003 | Watanabe et al. | 429/178 |
| 6,783,377 | B2 * | 8/2004 | Aoyama | 439/92 |
| 6,910,911 | B2 * | 6/2005 | Mellott et al. | 439/358 |
| 7,070,417 | B2 | 7/2006 | Meleck et al. | |
| 7,114,966 | B2 * | 10/2006 | Cecchi | 439/88 |
| 7,214,090 | B2 * | 5/2007 | Aihara et al. | 439/475 |
| 7,392,585 | B2 * | 7/2008 | Ostendorp | 29/857 |
| 7,887,332 | B2 * | 2/2011 | Bauer et al. | 439/13 |
| 8,079,880 | B2 * | 12/2011 | Lin et al. | 439/668 |
| 8,142,231 | B2 * | 3/2012 | Tung et al. | 439/660 |
| 8,172,596 | B2 | 5/2012 | Siebens | |
| 8,172,600 | B2 * | 5/2012 | Trottier et al. | 439/392 |
| 8,262,403 | B2 * | 9/2012 | Slippy et al. | 439/353 |
| 8,292,661 | B2 | 10/2012 | Montena | |
| 8,308,502 | B2 * | 11/2012 | Lang | 439/475 |
| 8,382,535 | B2 * | 2/2013 | Werthman et al. | 439/883 |
| 8,410,369 | B2 * | 4/2013 | Kim et al. | 174/153 G |
| 8,517,771 | B2 * | 8/2013 | Kan et al. | 439/638 |
| 8,591,249 | B2 * | 11/2013 | Harnish et al. | 439/474 |
| 8,764,309 | B2 * | 7/2014 | Wouters | 385/59 |
| 2013/0187601 | A1 * | 7/2013 | Petrie et al. | 320/109 |
| 2014/0242848 | A1 * | 8/2014 | Golko et al. | 439/660 |

* cited by examiner

ELECTRICAL CONNECTOR HAVING A DESIGNED BREAKING STRENGTH

BACKGROUND OF THE INVENTION

The present invention relates generally to electrical connectors and in particular to connectors having a designed breaking strength.

A wide variety of electronic devices are available for consumers today. Many of these devices have connectors that facilitate communication with and/or charging of the corresponding device. These connectors often interface with other connectors through cables that are used to connect devices to one another. Sometimes, connectors are used without a cable to directly connect the device to an accessory, such as a charging station or a sound system.

As smart-phones, media players and other electronic devices become more compact and feature intensive, their corresponding cost increases. Thus it is desirable to protect the electronic device from damage. Because connectors are often interfaced with the electronic device, sometimes it may be the connector that causes damage to the electronic device through a drop event or other externally applied force. Thus, connectors that protect the electronic device from damage are desirable.

BRIEF SUMMARY OF THE INVENTION

The present invention relates to attaching internal enclosures to connector bodies having relatively small geometry such that the connector has a designed breaking strength. By way of example, the connector design may be used on data and/or power connectors, such as USB connectors, Firewire connectors, Thunderbolt connectors and the like. The design enables plug connectors to break at a designed breaking strength before the connector tab and/or the receptacle connector in an electronic device breaks. This design is particularly useful when the plug connector is relatively strong and when it is desirable to protect the electronic device from damage resulting from the plug connector.

Some embodiments may comprise a plug connector having an inner enclosure including a first and a second portion. The inner enclosure may at least partially surround the body of the connector. The first and second inner enclosure portions may be bonded to a tab of the connector with one or more bond locations to provide a specific amount of mechanical strength to the body of the connector. In some embodiments the bond locations may be designed such that they will break before the connector tab. In further embodiments the plug connector may be mated with a receptacle connector and the bond locations in the plug connector may be designed such that they break before receptacle connector. In further embodiments the internal enclosure may be a unitary component. Some embodiments may have an outer enclosure that is disposed at least partially around the inner enclosure.

To better understand the nature and advantages of the present invention, reference should be made to the following description and the accompanying figures. It is to be understood, however, that each of the figures is provided for the purpose of illustration only and is not intended as a definition of the limits of the scope of the present invention.

DETAILED DESCRIPTION OF THE INVENTION

Figure 1:
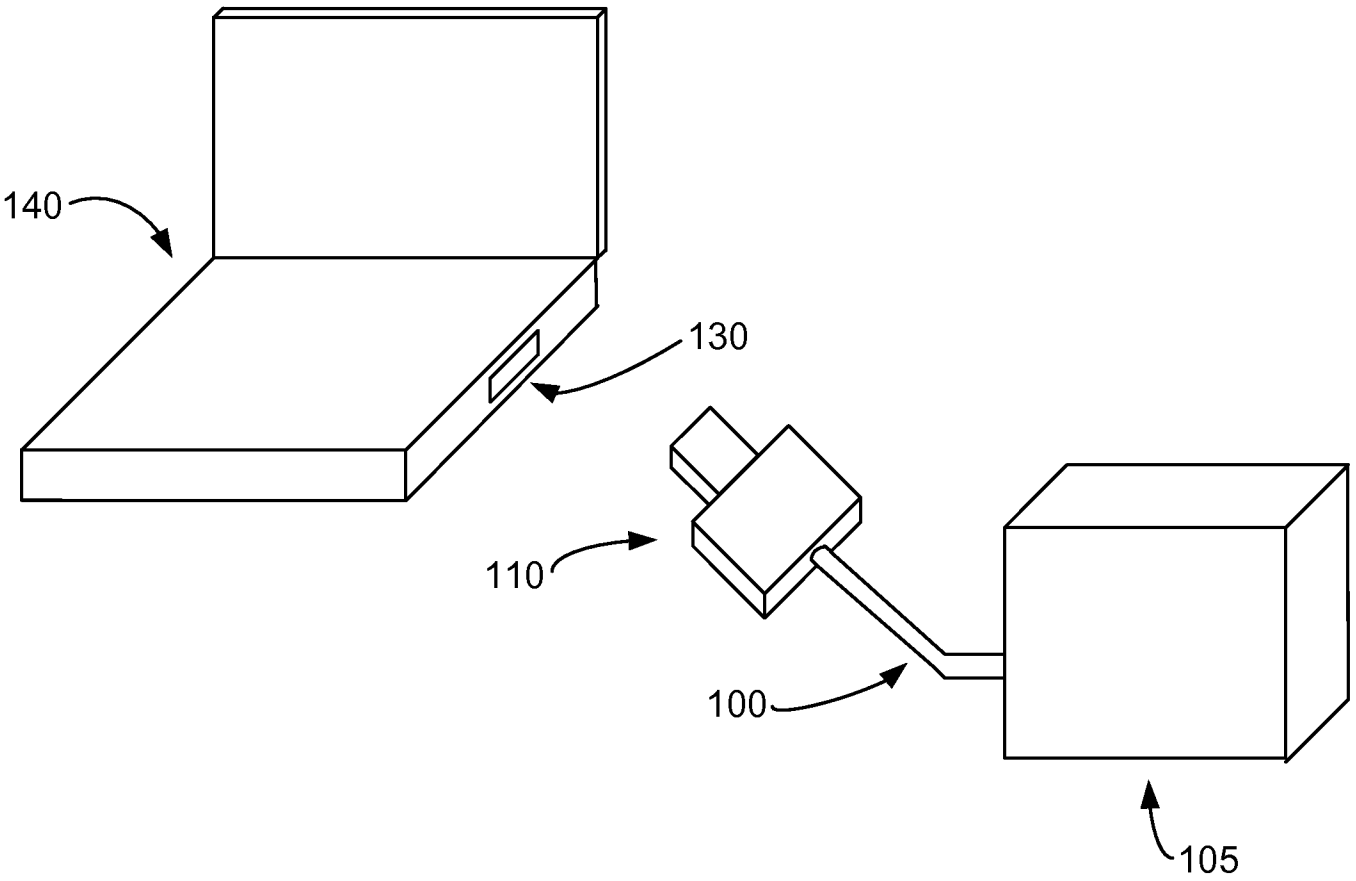
FIG. 1 is a diagram that illustrates an example two devices that can be interconnected with a cable, a plug connector and a connector receptacle.

Many electronic devices such as smart-phones, media players, and tablet computers have connectors that facilitate battery charging and/or communication with other devices. The connectors include a plurality of electrical contacts through which electrical connections are made to another compatible connector to transfer power and/or data signals through the connectors. FIG. 1 illustrates an example of two such connectors including a plug connector 110 and a receptacle connector 130. Each of these connectors 110, 130 may comply with a well-known standard such as Universal Serial Bus (USB) 2.0, Firewire, Thunderbolt, or the like or may be proprietary connectors, such as the 30-pin and the Lightning connectors used on many Apple products among other types of proprietary connectors.

As further shown in FIG. 1, plug connector 110 is coupled to a cable 100, which in turn is coupled to a peripheral device 105 that can be any of many different electronic devices or accessories that operate with such devices. Receptacle connector 130 is incorporated into a computing device 140. When the plug connector 110 is mated with the receptacle 130, contacts within each connector (not shown in FIG. 1) are in physical and electrical contact with each other to allow electrical signals to be transferred between computing device 140 and peripheral device 105.

Typically, the plug connector 110 is equipped with an internal enclosure (not shown) that covers the internal body of the connector. Thus, embodiments of the invention may be used in connector 110. To further illustrate embodiments of the invention, various examples of connectors that include internal enclosures that may be made in accordance with the present invention are discussed below; however these embodiments should in no way limit the applicability of the invention to other connectors.

Figure 2A:
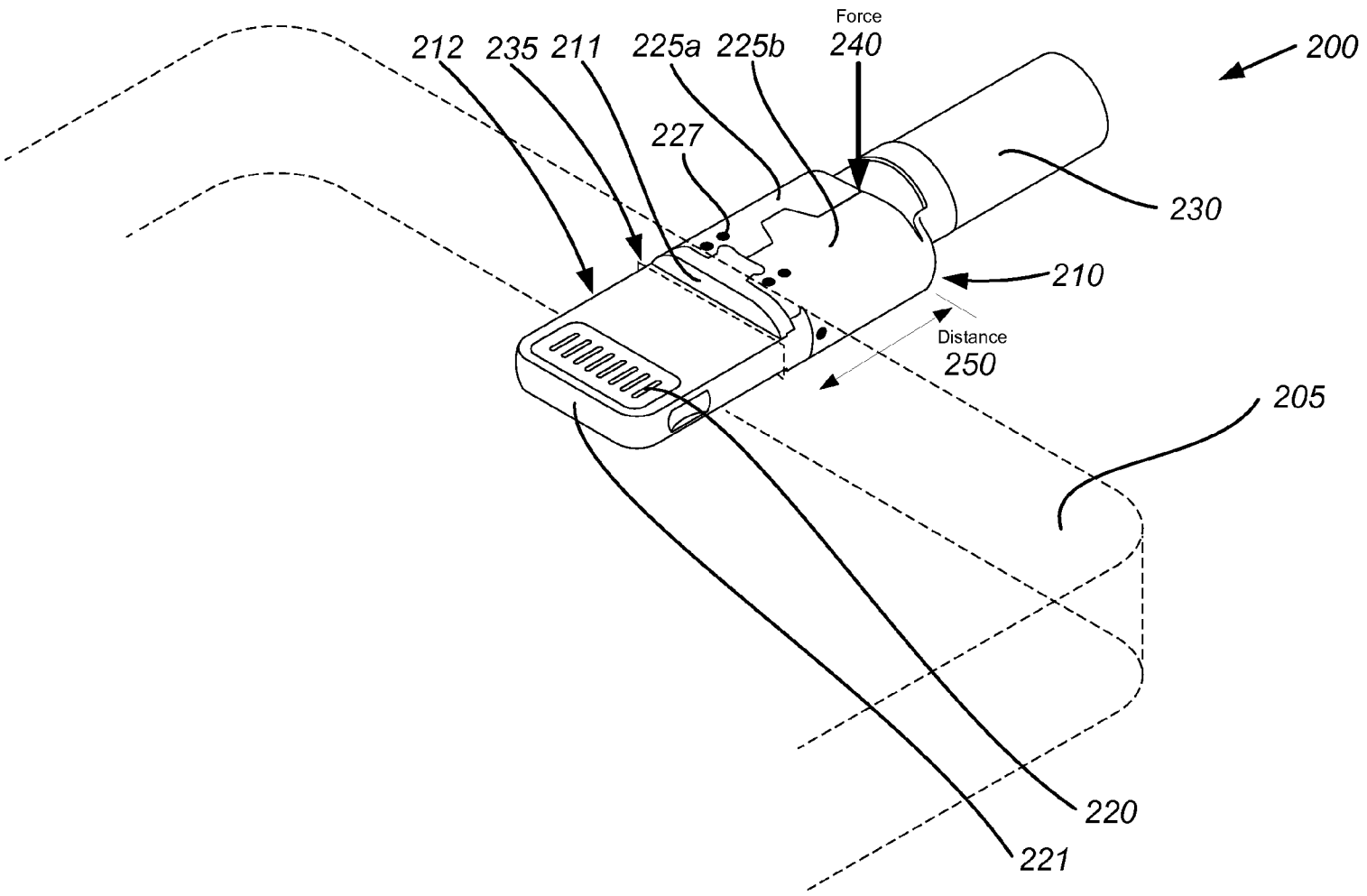
FIG. 2A is a diagram that illustrates a simplified example of a plug connector received in the receptacle connector of an electronic device.

As a first example, reference is made to FIG. 2A, which depicts a simplified view of a plug connector that can be used as connector 110 shown in FIG. 1. Plug connector 200 has a body 210 having a first face 211 and a tab 212 extending from the first face of the body to a distal end 221 of the plug connector. In some embodiments the perimeter of the plug connector is less than 30 mm. Plug connector 200 may further comprise an inner enclosure having a first portion 225*a* and a second portion 225*b*. First and second inner enclosure portions 225*a*, 225*b* may be bonded to a portion of tab 212 with one or more bond locations 227. Myriad methods may be employed to bond first and second inner enclosure portions 225*a*, 225*b* to tab 212, such as for example, adhesive or fasteners. Tab 212 may be configured to be received in an insertion cavity of a receptacle connector 235 located in an electronic device 205, and the tab may carry a plurality of contacts 220. Plug connector 200 may further have one or more electrical cables 230.

Plug connector 200 may be designed to break at bond locations 227 when a force 240 is applied at a distance 250 from receptacle connector 235. More specifically, when a cantilever force is applied at 240, a torque on plug connector 200 results and the one or more bonds between the first and second inner enclosure portions 225*a*, 225*b* and tab 212 may be broken. In some embodiments the number, size and configuration of bond locations 227 are specifically designed to break at a force 240 that is less than the breaking force of tab 212 and/or receptacle connector 235. Thus, by judicious design of bond locations 227, the plug connector 200 may break before receptacle connector 235, saving electronic device 205 from damage.

Figure 2B:
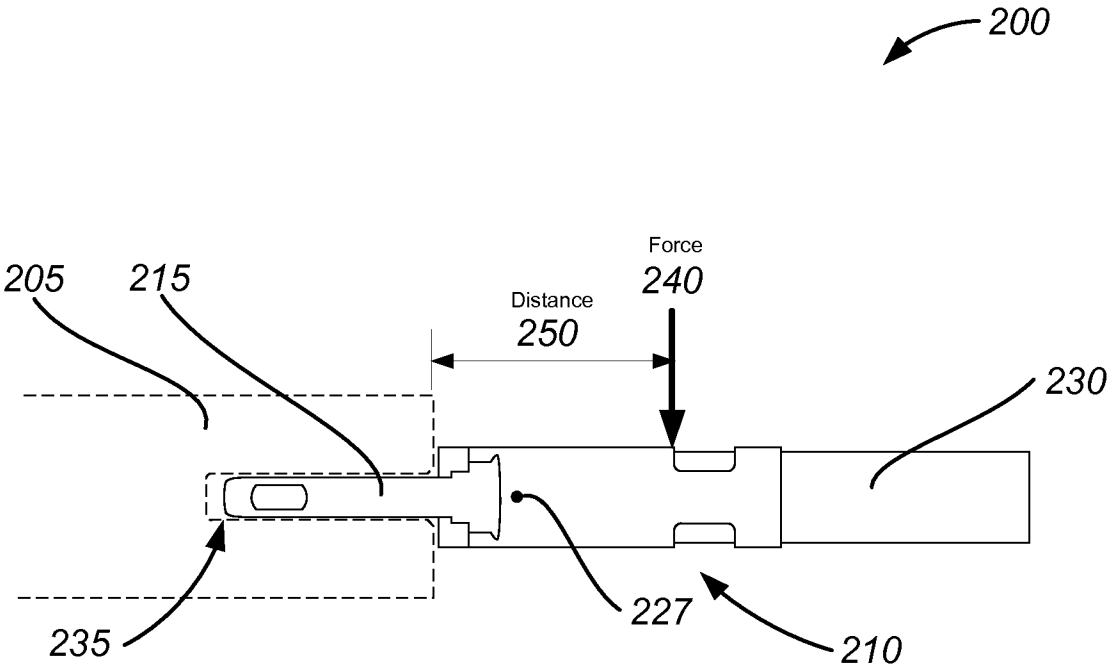
FIG. 2B is a diagram that illustrates a simplified side view of a plug connector received in the receptacle connector of an electronic device.

FIG. 2B shows a simplified side view of plug connector 200 engaged with electronic device 205. In this illustration the location of applied force 240 is more clearly shown as a simple point load at a distance 250 from the entrance of receptacle connector 235. Force 240 multiplied times distance 250 results in an applied torque exerted on plug connector 200. However it is understood that the actual force applied may not be a simple one dimensional point load and that other loads may be applied to plug connector 200. The forces shown here are for illustration only and other mechanical loads are within the scope of this disclosure. For example, in some embodiments plug connector 200 could be subject to a twisting load or an angular load and similar methods may be employed to ensure the plug connector breaks before tab 215 and/or receptacle connector 235.

In some embodiments plug connector 200 is designed to have a breaking strength that is a torque less than 3500 Newton-millimeters. More specifically, bond locations 227 (see FIG. 2A) may be designed to break at less than 3500 Newton-millimeters of applied torque, illustrated as force 240 at distance 250 from electronic device 205. In other embodiments the breaking strength of plug connector 200 is a torque less than 2500 Newton-millimeters. In further embodiments the breaking strength of plug connector 200 is a torque less than 1500 Newton-millimeters. In still further embodiments the breaking strength of plug connector 200 is a torque less than 500 Newton-millimeters.

Figure 3B:
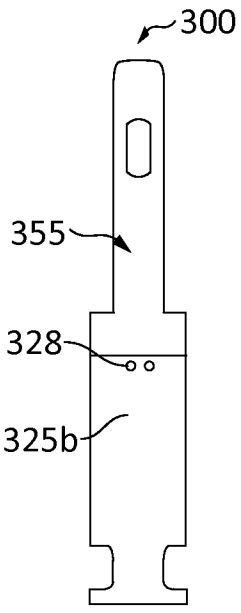
FIG. 3B is a diagram that illustrates a side view of an internal enclosure bonded to a connector tab.
Figure 3A:
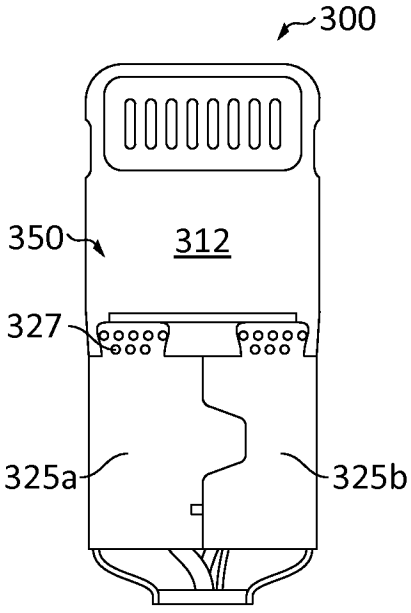
FIG. 3A is a diagram that illustrates a plan view of an internal enclosure bonded to a connector tab.

FIGS. 3A-5B illustrate example embodiments of different bond configurations. Other variants are within the scope of this disclosure. FIG. 3A illustrates a plan view of plug connector 300. Eight circular and staggered bond locations 327 are performed on a top face 350 of first and second internal enclosure portions 325*a*, 325*b*. Similar circular bonds may be performed on the opposite face of plug connector 300. FIG. 3B illustrates a view of the right side 355 of plug connector 300 and shows two bond locations 328 on the side of second internal enclosure portion 325*b*. Similar welds may be performed on first internal enclosure portion 325*a*. The bond locations may bond first and second internal enclosure portions 325*a*, 325*b* to tab 312.

Figure 4B:
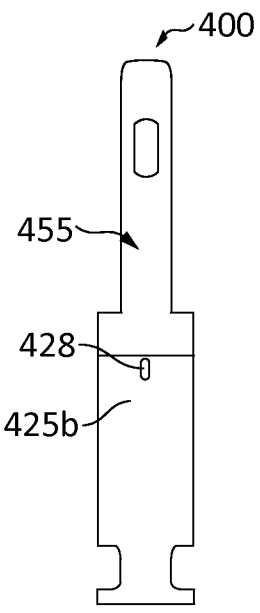
FIG. 4B is a diagram that illustrates a side view of an internal enclosure bonded to a connector tab.
Figure 4A:
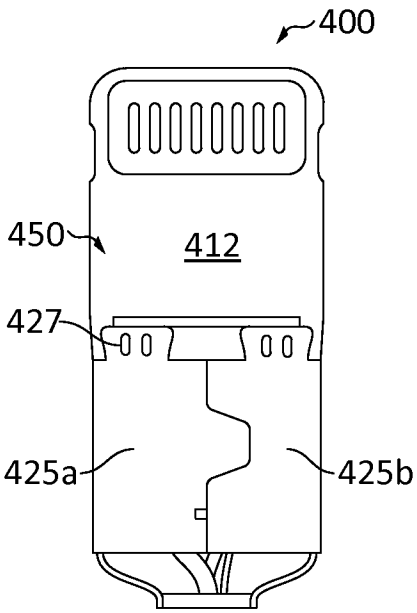
FIG. 4A is a diagram that illustrates a plan view of an internal enclosure bonded to a connector tab.

FIG. 4A illustrates a plan view of connector plug 400. Two elongated bond locations 427 are performed on a top face 450 of first and second internal enclosure portions 425*a*, 425*b*. Similar elongated bonds may be performed on the opposite face of plug connector 400. FIG. 4B illustrates a view of the right side 455 of plug connector 400 and shows one elongated bond location 428 on the side of second internal enclosure portion 425*b*. Similar bonds may be performed on first internal enclosure portion 425*a*. The bond locations may bond first and second internal enclosure portions 425*a*, 425*b* to tab 412.

Figure 5B:
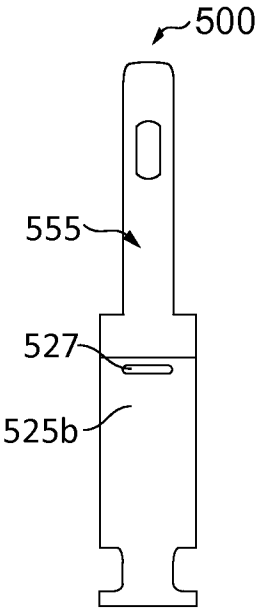
FIG. 5B is a diagram that illustrates a side view of an internal enclosure bonded to a connector tab.
Figure 5A:
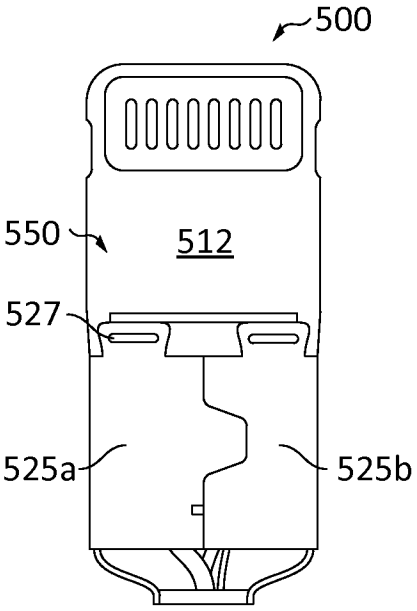
FIG. 5A is a diagram that illustrates a plan view of an internal enclosure bonded to a connector tab.

FIG. 5A illustrates a plan view of connector plug 500. One elongated bond location 527 is performed on a top face 550 of first and second internal enclosure portions 525*a*, 525*b*. Similar elongated bonds may be performed on the opposite face of plug connector 500. FIG. 5B illustrates a view of the right side 555 of plug connector 500 and shows one elongated bond location 528 on the side of second internal enclosure portion 525*b*. Similar bonds may be performed on first internal enclosure portion 525*a*. The bond locations may bond first and second internal enclosure portions 525*a*, 525*b* to tab 512.

It will be appreciated that the plug connector configurations described herein are illustrative that variations and modifications are possible. For instance, in some embodiments bond locations 227 (see FIG. 2A) may comprise a combination of circular and elongated shapes. In other embodiments there may be one single bond location while in other embodiments there may be a plurality of bond locations. Further embodiments may have no bond locations on the side faces of the first and second internal enclosure portions. Some embodiments may have metallic internal enclosure portions that are bonded to a metallic tab. Further embodiments may perform bonding using, for example, a laser or spot welder. Other embodiments may use an adhesive or an epoxy to bond the first and second internal enclosure portions to the tab. Further embodiments may comprise first and second internal enclosure portions and the tab made from plastic and the bonding may be performed using an ultrasonic or thermosonic wand. Other embodiments may have a unitary internal enclosure.

Figure 6:
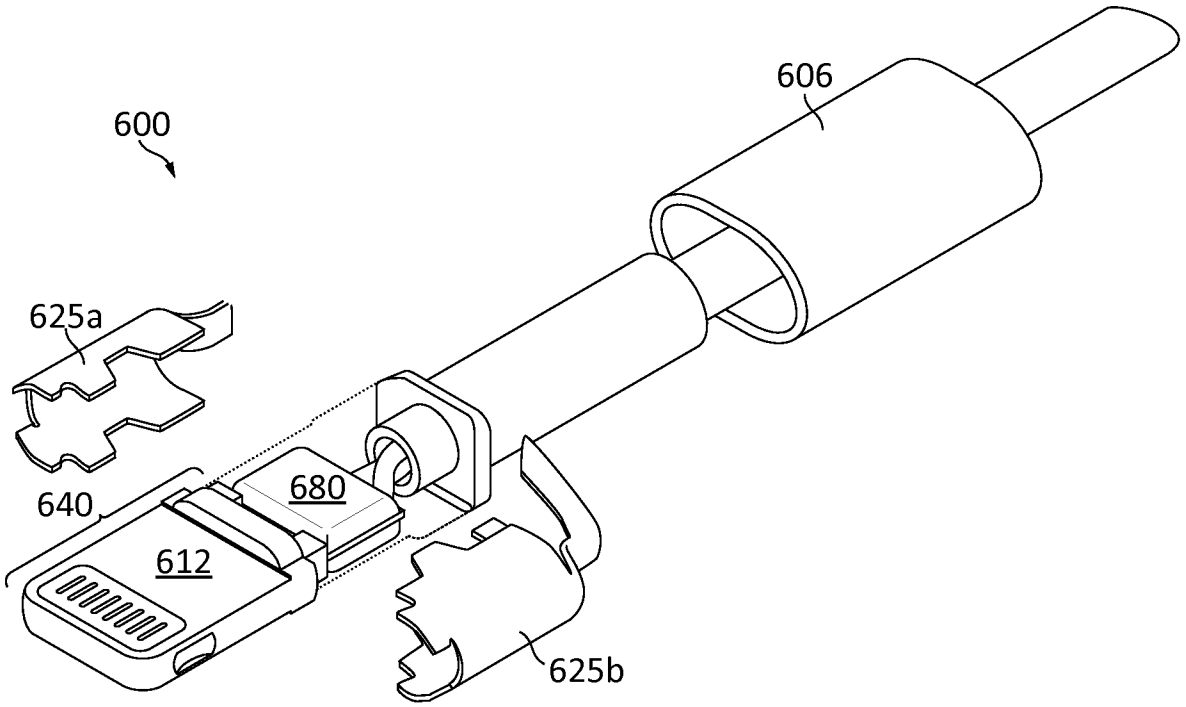
FIG. 6 is a diagram that illustrates an isometric exploded view of a plug connector.
Figure 7:
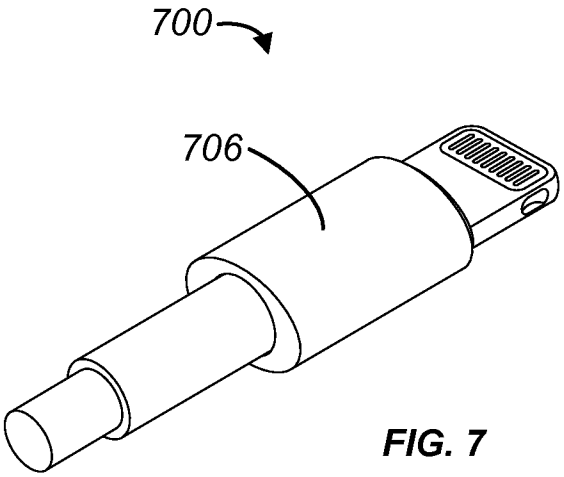
FIG. 7 is a diagram that illustrates an isometric view of an assembled plug connector.
Figure 8:
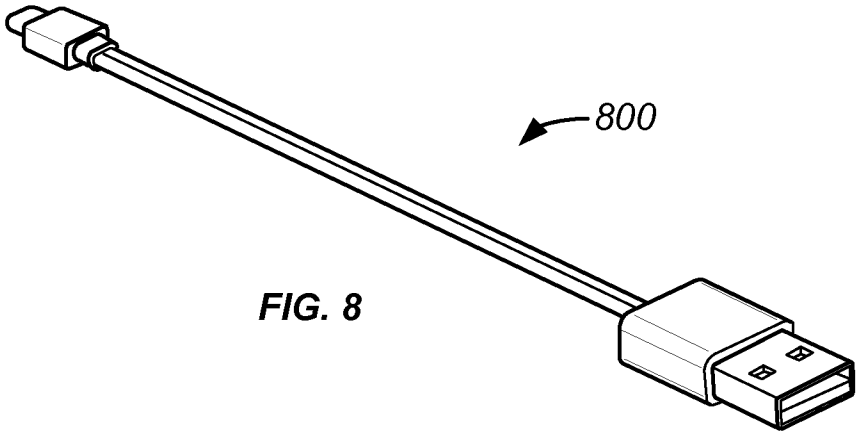
FIG. 8 is a diagram that illustrates an isometric view of a cable.

FIG. 6 shows an example connector plug 600 with the first and second internal enclosure portions 625*a*, 625*b* moved outward for clarity. Internal components 680 may be disposed inside of first and second enclosure portions 625*a*, 625*b*. In this illustration it can be seen that in some embodiments, tab 612 is substantially unitary and has a length 640. In some embodiments there may be an outer enclosure 606 that may be slid over first and second internal enclosure portions 625*a*, 625*b* such that the outer enclosure is disposed at least partially around the inner enclosure. FIG. 7 shows a one embodiment of a completed plug connector 700 with outer enclosure 706 in its final position over the inner enclosure (not shown). Such embodiments may be used to terminate one or both ends of a cable 800, as illustrated in FIG. 8.

Figure 9B:
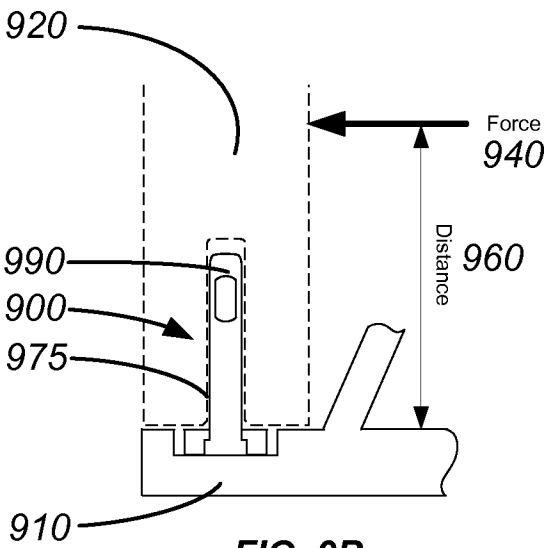
FIG. 9B is a diagram that illustrates a simplified side view an electronic device received in an accessory.
Figure 9A:
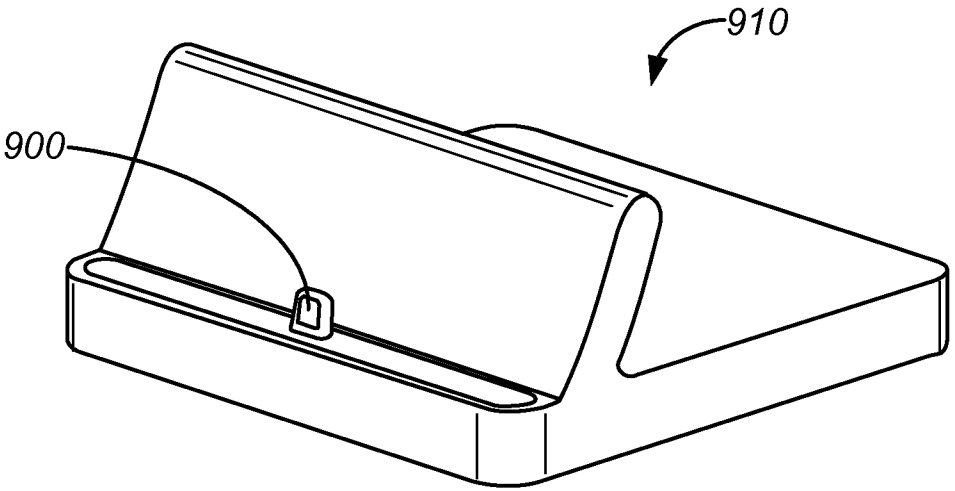
FIG. 9A is a diagram that illustrates an isometric view an electronic device accessory.

Another embodiment that incorporates a plug connector having an internal enclosure is illustrated in FIG. 9A. In this embodiment, plug connector 900 is installed in accessory 910. FIG. 9B shows a simplified cross sectional view of accessory 910 with electronic device 920 mated with plug connector 900. FIG. 9B also illustrates how a force 940 may be applied to electronic device 920 at a distance 960 from an entrance of receptacle connector 975 in the electronic device. Applied force 940 may, as discussed above, apply a torque force on plug connector 900. The body of plug connector 900 may be designed as illustrated in FIGS. 3A-5B to break at a force that is less than the breaking force of tab 990 and/or receptacle connector 975. Thus, by judiciously designing the breaking force of the bond locations (see FIGS. 3A-5B), plug connector 900 may break before receptacle connector 975, saving electronic device 920 from damage.

Figure 10:
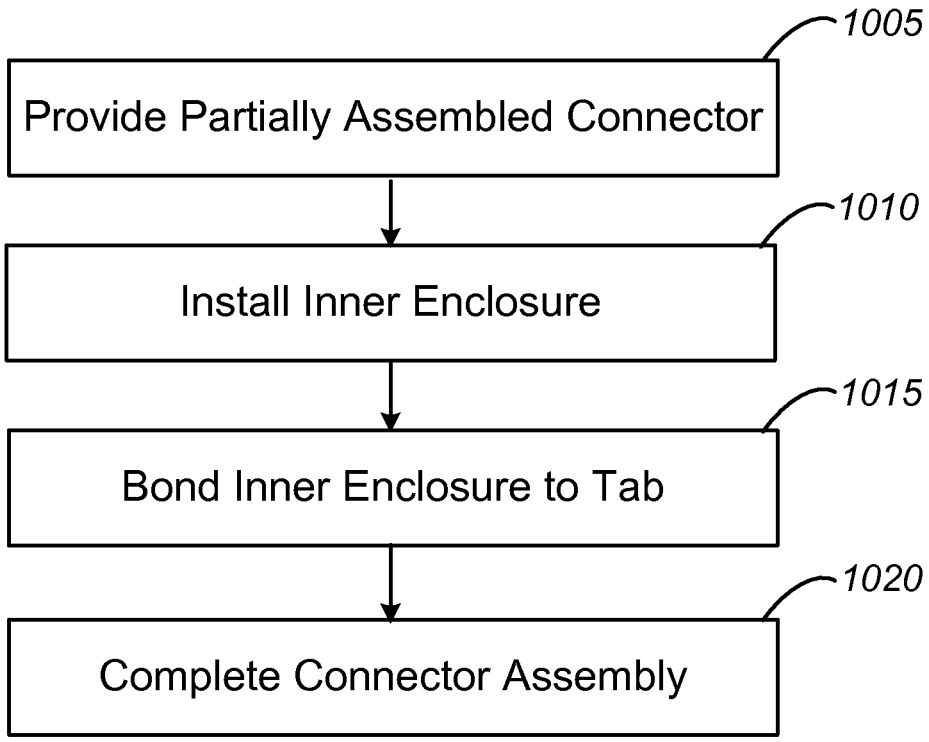
FIG. 10 is a process by which a connector having an internal enclosure in accordance with an embodiment of the invention can be manufactured.

FIG. 10 illustrates a process by which a connector having an inner enclosure with a breaking strength less than that of the connector tab and/or the receptacle connector may be made. In step 1005 a partially assembled connector is provided. In step 1010 the inner enclosure is installed at least partially around the connector body. In some embodiments the inner enclosure comprises two portions while in other embodiments it may only comprise one portion. In step 1015 the inner enclosure is bonded to at least a portion of the connector tab. In some embodiments the inner enclosure may be metal and may be welded or glued to a metallic tab. In other embodiments the inner enclosure may be plastic and may be heat welded or glued to the tab. In step 1020 the connector assembly is completed. In some embodiments an outer enclosure is disposed at least partially around the inner enclosure.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. A plug connector comprising:

a body having a first face and a tab extending from the first face of the body to a distal end of the plug connector;

the tab carrying a plurality of contacts and configured to be received in an insertion cavity of a receptacle connector;

a metal inner enclosure that at least partially surrounds the body;

the inner enclosure welded to at least a portion of the tab with one or more weld locations;

wherein the plug connector is designed to break at the one or more weld locations when torque is applied to the plug connector.

2. The plug connector set forth in claim 1 wherein a breaking strength of the plug connector is a torque less than 3500 Newton-millimeters.

3. The plug connector set forth in claim 2 wherein the breaking strength is a torque less than 2500 Newton-millimeters.

4. The plug connector set forth in claim 2 wherein the breaking strength is a torque less than 1500 Newton-millimeters.

5. The plug connector set forth in claim 2 wherein the breaking strength is a torque less than 500 Newton-millimeters.

6. The plug connector set forth in claim 1 wherein the plug connector is configured to mate with a corresponding receptacle and the breaking strength of the plug connector is less than a breaking strength of the receptacle.

7. The connector set forth in claim 1 wherein the one or more weld locations are designed break at a torque that is less than a breaking strength of the tab.

8. The connector set forth in claim 1 wherein the inner enclosure comprises first and second portions.

9. The connector set forth in claim 1 wherein the one or more weld locations include a combination of circular and elongated shapes.

10. The connector set forth in claim 9 wherein the tab has first and second opposing faces and wherein the one or more weld locations include locations on each of the first and second opposing faces.

11. The connector set forth in claim 10 wherein the tab further includes first and second opposing sides that extend between the first and second opposing faces and wherein the one or more weld locations include at least one location on each of the first and second opposing sides.

12. A method of making a plug connector comprising:

forming a body, the body having a first face and a tab extending from the first face of the body to a distal end of the plug connector;

disposing a plurality of contacts in the tab, the tab configured to be received in a receptacle;

forming an inner enclosure that at least partially surrounds the body;

bonding the inner enclosure to at least a portion of the tab;

wherein the plug connector is designed to break at the bond when torque is applied to the plug connector.

13. The method set forth in claim 12, wherein the perimeter of the body is less than or equal to 30 mm.

14. The method set forth in claim 12, wherein the inner enclosure comprises a first portion and a second portion.

15. The method set forth in claim 12, further comprising:

forming an outer enclosure disposed at least partially around the inner enclosure.

16. The method set forth in claim 12, wherein the bond is designed to break at a force that is less than a force required to break the tab.

17. The method set forth in claim 12, wherein the bond is designed to break at a force that is less than a force required to break the receptacle.

18. The method set forth in claim 12, wherein the plug connector is mounted in an accessory.

* * * * *